US007500691B2

(12) United States Patent
Haas

(10) Patent No.: US 7,500,691 B2
(45) Date of Patent: Mar. 10, 2009

(54) SNOW GLIDE BOARD AND METHOD OF MAKING A SNOW GLIDE BOARD

(75) Inventor: Christian Haas, Bogen (DE)

(73) Assignee: Volkl Sports GmbH & Co. KG, Straubing (DE)

( * ) Notice: Subject to any disclaimer, the term of this patent is extended or adjusted under 35 U.S.C. 154(b) by 256 days.

(21) Appl. No.: 10/943,009

(22) Filed: Sep. 17, 2004

(65) Prior Publication Data

US 2005/0062259 A1 Mar. 24, 2005

(30) Foreign Application Priority Data

Sep. 19, 2003 (DE) ..... 203 14 511 U
Oct. 21, 2003 (DE) ..... 203 16 290 U

(51) Int. Cl.
*A63C 5/052* (2006.01)

(52) U.S. Cl. ..... 280/608; 280/609

(58) Field of Classification Search ..... 280/14.22, 280/601, 608, 609, 610, 809
See application file for complete search history.

(56) References Cited

U.S. PATENT DOCUMENTS 3,066,326 A * 12/1962 Collins ..... 441/68
3,424,469 A * 1/1969 Hooker ..... 280/608
3,814,452 A * 6/1974 Arnsteiner ..... 280/610
3,876,216 A * 4/1975 Wehr ..... 280/601
4,083,572 A * 4/1978 May, Jr. ..... 280/816
4,275,904 A * 6/1981 Pedersen ..... 280/818
4,616,842 A * 10/1986 Echevin et al. ..... 280/602
4,861,063 A * 8/1989 Abondance ..... 280/601
4,981,455 A * 1/1991 Tubens ..... 441/73
D316,585 S * 4/1991 Skedeleski et al. ..... D21/776
5,143,394 A * 9/1992 Piana ..... 280/602
5,292,146 A * 3/1994 Palau ..... 280/601
5,310,221 A * 5/1994 Schmidt ..... 280/809
5,360,228 A * 11/1994 Palau ..... 280/609
5,397,153 A * 3/1995 Dutaut et al. ..... 280/809
5,435,589 A * 7/1995 Fagot ..... 280/610
5,618,054 A * 4/1997 Fagot ..... 280/610
5,664,808 A * 9/1997 Whidden et al. ..... 280/815
6,012,734 A * 1/2000 Skedeleski ..... 280/610
6,036,218 A * 3/2000 Muff, Jr. ..... 280/608
6,349,961 B1 * 2/2002 Colley et al. ..... 280/608
6,565,104 B1 * 5/2003 Colon ..... 280/87.042
6,945,563 B2 * 9/2005 Clausing ..... 280/809
7,059,623 B1 * 6/2006 Yeh ..... 280/605

* cited by examiner

*Primary Examiner*—Jeffrey J Restifo
(74) *Attorney, Agent, or Firm*—Hoffman, Wasson & Gitler

(57) ABSTRACT

A snow glide board with a glide board body with a front end and a rear end has an insert inserted on at least one end of the glide board body in a body recess located there such, that the insert adjoins with an insert bottom side a bottom side of the glide board body. The insert is shaped so that it forms at least one depression or cavity or insert recess on its bottom side, which (recess) is open toward the bottom of the glide board body and that the insert is made of a permanently deformable material.

20 Claims, 2 Drawing Sheets

SNOW GLIDE BOARD AND METHOD OF MAKING A SNOW GLIDE BOARD

BACKGROUND OF THE INVENTION

The invention relates to a snow glide board, for example a snowboard, and to a method of making a board.

An object of the invention is to present a snow glide board with improved running characteristics.

SUMMARY OF THE INVENTION

The use of a thermoplastic plastic material for the at least one insert makes it possible to mount this insert in the glide board body in a form that does not have the recess on the bottom of the insert, i.e. non-convex form, and then to mechanically process the bottom of the glide board body and the bottom of the insert, i.e. to polish and/or grind them, in order to attain a smooth surface for optimum running characteristics not only for the bottom of the glide board body, but also for the bottom of the insert. In a subsequent processing step, the insert is permanently formed by heat so that it then has the recess or depression that is open toward the bottom and toward the end of the glide board body.

BRIEF DESCRIPTION OF THE DRAWINGS

The invention is described below by way of an example based an exemplary embodiment with reference to the drawings, in which.

DETAILED DESCRIPTION OF THE INVENTION

Figure 1:
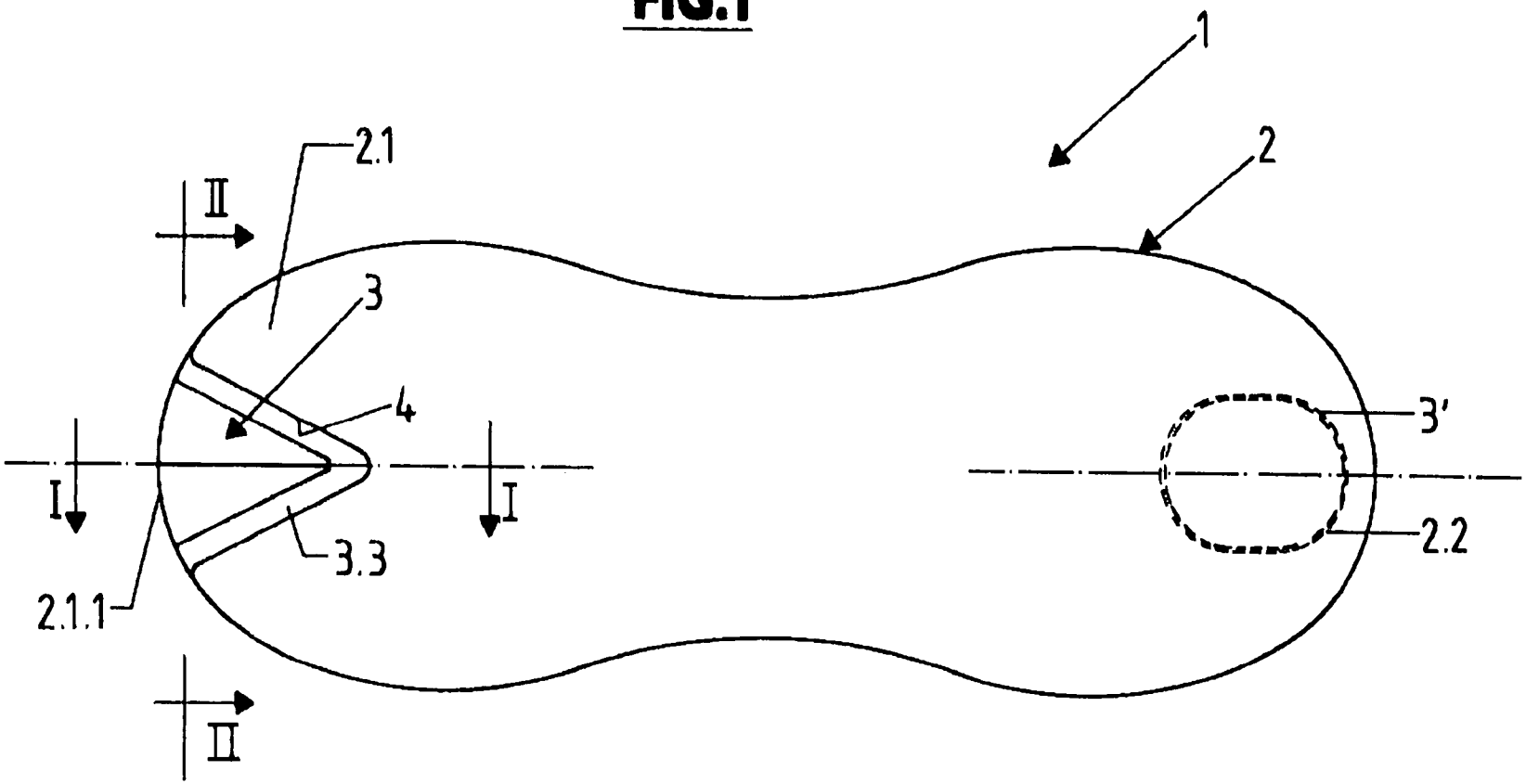
FIG. 1 shows a simplified representation in top view of a snow glide board in the form of a snowboard according to the invention.
Figure 3:
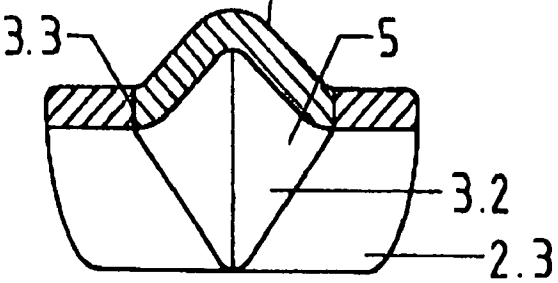
FIGS. 2 and 3 show simplified sections corresponding to the lines I-I (FIG. 2) and II-II (FIG. 3), each in the rear area of the snow glide board and in the proximity of an insert located there and made of a permanently formable material.

In the drawings, there is depicted a snow glide board 1 in the form of a snowboard. The snowboard body 2 has the usual design, structure and form, in particular with a rear, shovel-like upward curved end or shovel area 2.1 and a front, also shovel-like upward curved end or shovel area 2.2.

In deviation from the usual design, in the snowboard 1 there is an insert 3 which is inserted into the snowboard body 2 on the rear shovel area 2.1. The insert 3 is made of a permanently formable material, i.e. in the depicted embodiment, of a thermoplastic plastic material or polymer. The snowboard 1 has a wedge shape, or the form of a rounded V, such that this insert 3, which in the depicted embodiment is symmetrical to the longitudinal axis L of the snowboard body 2 and located in the snowboard body 2, has a width in an axis direction that is perpendicular to the longitudinal axis L which width increases toward the free edge 2.1.1 of the rear shovel area 2.1.

The insert 3 has a top 3.1, a bottom 3.2 and an edge area 3.3 and also, in the depicted embodiment, a material thickness that is equal to the material thickness of the snowboard body 2 in the proximity of the shovel area 2.1. Furthermore, the insert 3 is designed so that at least its bottom 3.1 is flush with the bottom 2.3 of the snowboard body, i.e. merges flush with the bottom 2.3 of the snowboard body.

For holding the insert 3, the snowboard body 2 is provided on its rear end or shovel area 2.2 with a V-shaped recess 4 that is adapted to the shape of the insert 3.

With the exception of the edge area 3.3, on which the insert 3 adjoins to the snowboard body 2, and with which it is connected to the snowboard body 2, the insert 3 is curved, such that it has a convex shape on the top 3.1 and a concave shape on the bottom 3.2, thus forming a depression or recess 5, which can also be referred to as a cavity or tunnel, which is also open toward the rear, free edge 2.1.1 of the shovel area 2.1 also formed by the insert 3 and the depth and width (in the axis direction perpendicular to the longitudinal axis L) of which decrease as the distance from this free edge 2.1.1 increases. The recess 5, in the depicted embodiment, is symmetrical to the longitudinal axis L, and has the shape of a rounded V in top view of the bottom 2.3 of the snowboard body 2 and extends in the depicted embodiment over the entire or the majority of the upward curved rear shovel area 2.1.

Figure 5:
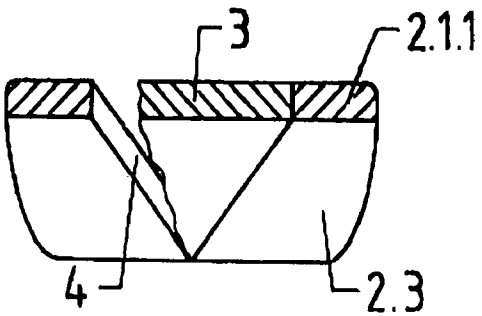
FIGS. 4 and 5 show representations similar to FIGS. 2 and 3, however before forming of the insert.
Figure 2:
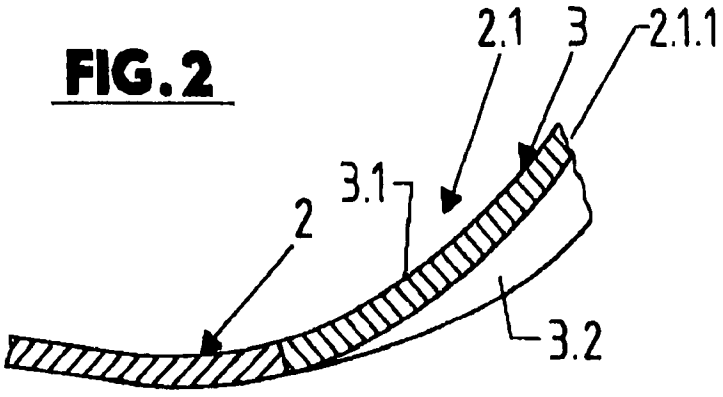
Figure 4:
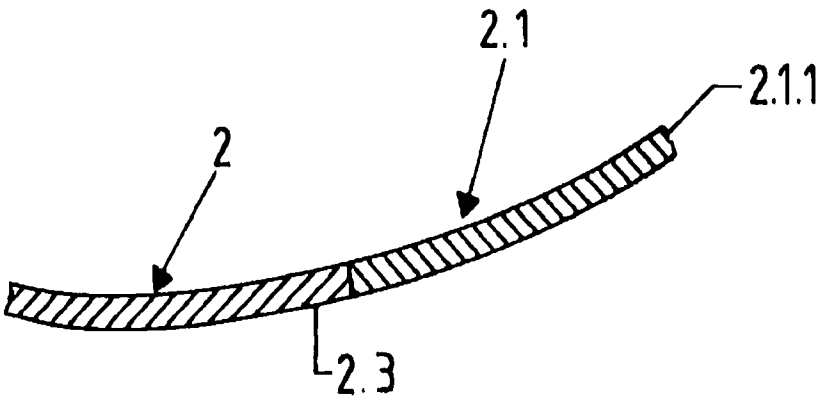

Like the bottom 2.3 of the snowboard body 2, forming the glide surface, the bottom 3.2 of the insert 3 is also mechanically processed, i.e. polished and/or grinded, in order to achieve optimum glide properties. In order to enable this, despite the shape of the insert 3, this insert is made of the thermoplastic plastic material or polymer in the depicted embodiment, namely according to FIGS. 4 and 5 initially without the curve forming the tunnel or recess 5, so that the bottom 3.2 of the insert 3 forms the continuation of the adjoining bottom 2.3 of the snowboard body 2, i.e. lies with the latter in the common curved plane defined by the curved shovel area 2.1 and therefore the bottom 2.3 and the bottom 3.2 of the insert 3 fastened in the snowboard body 2 can be processed for example polished and/or grinded together. Only after this the insert 3 is formed permanently into its curved shape.

In the depicted embodiment, the insert 3 consists of a transparent, thermoplastic polymer or plastic.

The cavity or recess 5 positively influences the flow of the snow, or the gliding in the snow, when snowboarding. This results, for example, in improved guiding of the snowboard 1, especially in powder snow, in addition to reduced resistance in the rear shovel area 2.1. Provided are improved deep snow properties. Furthermore, the insert enables better spray, i.e. improved snow dust formation at the rear shovel area 2.1 when running in deep snow.

An insert 3, with a V-shape in the snowboard body 2, was described above. It goes without saying that other shapes are possible, for example a disk-shaped insert 3' indicated in FIG. 1 by a broken line in the shovel area 2.2. The insert is inserted in a recess in the snowboard body 2, or in the shovel area 2.2, forming a closed edge. The insert 3' is concave on the bottom of the snowboard body 2 for forming the recess corresponding to the recess 5 and accordingly convex on the top of the snowboard. Of course, other shapes are also possible for individual applications, for example, inserts with a strip shape. Furthermore, it is also possible to provide a plurality of inserts on each end of the snowboard body 2. Furthermore, it is possible to design the respective insert 3, or 3'; so that it is softer than the surrounding snowboard body.

The invention was described above based on an exemplary embodiments. It goes without saying that further modifications and variations are possible, without abandoning the underlying inventive idea of the invention. For example, it is also possible to design the insert 3 or 3' of several layers, for example for increased stability and/or adaptation to various material requirements, e.g. on the top and bottom of the snowboard body 2 etc.

Reference List

1 snowboard
2 snowboard body
2.1, 2.2 rear or front shovel area
2.3 bottom of snowboard body
2.1.1 rear edge area
3, 3' insert
3.1 top of insert
3.2 bottom of insert
3.3 edge area
4 recess in snowboard body or in rear shovel area 2.1 for the insert 3
5 tunnel or recess

What is claimed is:

1. A snow glide board comprising
a glide board body,
a glide board body front end and a glide board body rear end which are offset from each other in a direction of a longitudinal glide board axis (L),
a glide board body recess formed in the glide board body on at least one of said glide board body ends,
an insert in the glide board body recess, the insert adjoins with an insert bottom side to a bottom side of the glide board body,
the insert having a longitudinal bend forming an inverted V shape extending upward beyond the board edge and having and at least one insert recess on the insert bottom side,
the insert recess is open toward the bottom of the glide board body and is located in or extends into the glide board body recess, and the insert is made of a permanently deformable material.

2. The snow glide board as claimed in claim 1, wherein the at least one insert recess is open toward one rear or front edge area of the glide board body.

3. The snow glide board as claimed in claim 1, wherein the at least one insert recess is closed toward one front or rear edge area of the glide board body.

4. The snow glide board as claimed in claim 1, wherein the insert is made of a thermoplastic plastic material.

5. The snow glide board as claimed in claim 1, wherein the insert is softer or more elastic than the surrounding glide board body.

6. The snow glide board as claimed in claim 1, wherein the insert is convex on its top for forming the insert recess.

7. The snow glide board as claimed in claim 1, wherein the insert has a surface on its bottom, also in the area of the insert recess that is mechanically processed, polished and/or ground.

8. The snow glide board as claimed in claim 1, wherein the bottom of the insert forms part of the glide surface of the snow glide board.

9. The snow glide board as claimed in claim 1, wherein the insert made of a mono-layer or multi-layer material.

10. The snow glide board as claimed in claim 1, wherein the insert forms at least part of the edge area of the rear or front end of the glide board body.

11. The snow glide board as claimed in claim 1, wherein the at least one end is an upward curved shovel area of the glide board body.

12. The snow glide board as claimed in claim 1, wherein the insert recess has a longitudinal extension that is oriented in the direction of one longitudinal axis of the glide board body.

13. The snow glide board as claimed in claim 1, wherein the insert in top view of the top or bottom of the glide board body has the shape of a rounded wedge.

14. The snow glide board as claimed in claim 1, wherein the insert has an approximately V-shaped edge area along which the insert is connected to the glide board body or to the edge of the recess in the glide board body.

15. The snow glide board as claimed in claim 1, wherein the glide board body recess in the glide board body is V-shaped or wedgeshaped and is open toward the edge area.

16. The snow glide board as claimed in claim 1, wherein the insert is diskshaped and is located in an opening in the glide board body.

17. The snow glide board as claimed in claim 1, wherein the at least one insert is provided on only one end of the glide board body.

18. The snow glide board as claimed in claim 1, wherein there is at least one insert at both ends of the glide board body.

19. The snow glide board as claimed in claim 11, wherein the at least one insert is inserted in a glide board recess on the upward curved shovel area of the glide board body.

20. A method for making a snow glide board with
a glide board body,
a glide board body recess formed in the glide board,
a glide board body front end and a rear end which are offset from each other in a direction of a longitudinal glide board axis (L)
an insert inserted on at least one end of the glide board body in the glide board body recess, the insert adjoins with an insert bottom side to a bottom side of the glide board body,
the insert is shaped with a concave insert bottom side so that it forms at least one insert recess on the insert bottom side, the insert recess is open toward the bottom of the glide board body and is located in or extends into the glide board body recess, the method comprising the following steps:
(i) providing a glide board body with at least one glide board recess on at least one end of the glide board body,
(ii) inserting an insert in the glide board recess such, that at least the insert bottom side adjoins with a bottom side of the glide board body,
(iii) processing, polishing and/or grinding the insert bottom side an the bottom side of the glide board body together, and
(iiii) permanently deforming the insert such, that it protrudes the upper side of the glide board body and is shaped with the concave insert bottom side so that it forms the at least one insert recess on the insert bottom side.

* * * * *